US010507499B2

(12) United States Patent
Dixon

(10) Patent No.: US 10,507,499 B2
(45) **Date of Patent: *Dec. 17, 2019**

(54) SYSTEM FOR FACILITATING THE TRANSPORTATION OF HANGERS

(71) Applicant: Production Plus Corp., Ashville, OH (US)

(72) Inventor: Donovan Dixon, South Bloomfield, OH (US)

(73) Assignee: Production Plus Corp., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/911,826

(22) Filed: Mar. 5, 2018

(65) Prior Publication Data

US 2018/0257120 A1 Sep. 13, 2018

Related U.S. Application Data

(63) Continuation of application No. 14/930,996, filed on Nov. 3, 2015, now Pat. No. 9,943,891.

(51) Int. Cl.

| | |
|---|---|
| ***B08B 11/02*** | (2006.01) |
| ***B44D 3/16*** | (2006.01) |
| *B08B 7/00* | (2006.01) |

(52) U.S. Cl.

CPC ..... *B08B 11/02* (2013.01); *B44D 3/16* (2013.01); *B08B 7/0071* (2013.01)

(58) Field of Classification Search

CPC ..... C25D 17/08; C25D 17/06; B05B 5/082; B05B 13/00; B05B 13/0285; B05B 13/0292; B05B 13/02; B44D 3/16; B08B 7/0071; B08B 11/02

See application file for complete search history.

(56) References Cited

U.S. PATENT DOCUMENTS

| | | | | | |
|---|---|---|---|---|---|
| 1,184,246 | A | * | 5/1916 | Klein | A47B 23/042 211/50 |
| 1,590,698 | A | * | 6/1926 | Ray | C14B 1/58 211/41.1 |
| 2,505,212 | A | * | 4/1950 | Schneider | C25D 17/08 204/297.09 |
| 2,514,923 | A | * | 7/1950 | Batina | C25D 17/08 204/222 |
| 2,533,464 | A | * | 12/1950 | Jasper | C25D 17/08 204/297.07 |
| 2,557,231 | A | * | 6/1951 | Miller | B05B 13/0285 118/503 |
| 2,652,359 | A | * | 9/1953 | Schneider | C25D 17/08 204/297.1 |

(Continued)

*Primary Examiner* — Patrick D Hawn

(74) *Attorney, Agent, or Firm* — Standley Law Group LLP

(57) ABSTRACT

A rack includes a first and second substantially horizontal rail extending between a first and second substantially vertical rail. Upper portions of hangers used to suspend parts for powder coating, are suspended over an upper surface of the first substantially horizontal rail. A second substantially horizontal rail is moveably attached to the vertical rails so that it may be selectively moved into contact with the first substantially horizontal rail, thereby trapping the upper portion of the suspended hangers between the first and second substantially horizontal rails so they may be transported for cleaning.

18 Claims, 3 Drawing Sheets

(56) References Cited

U.S. PATENT DOCUMENTS 2,858,265 A * 10/1958 Schneider ..... C25D 17/08 204/297.09
2,858,266 A * 10/1958 Schneider ..... C25D 17/08 204/297.09
3,029,952 A * 4/1962 Bagdon ..... B65G 17/20 211/117
3,095,665 A * 7/1963 Killen ..... A47B 97/08 248/449
3,118,545 A * 1/1964 Rosner ..... C25D 17/08 204/297.09
3,484,361 A * 12/1969 Sperry ..... C25D 17/08 204/297.06
3,715,097 A * 2/1973 Kalajian ..... A47B 97/04 248/449
3,799,488 A * 3/1974 Sena ..... A47B 97/08 248/126
3,901,788 A * 8/1975 Schaer ..... C25D 7/04 204/222
D238,029 S 12/1975 Howard et al.
4,037,727 A * 7/1977 Kunkle ..... A47F 5/10 204/297.07
4,097,359 A * 6/1978 Davitz ..... B05B 5/082 118/500
4,129,217 A * 12/1978 Campbell ..... B05B 16/40 211/95
4,134,614 A * 1/1979 Fielding, Sr. ..... A47B 83/008 248/118
4,217,853 A * 8/1980 Davitz ..... B05B 5/082 118/500
4,243,146 A * 1/1981 Davitz ..... B05C 13/00 118/500
4,558,522 A * 12/1985 Lance ..... B43L 15/00 248/449
4,628,859 A * 12/1986 Hines ..... B05B 5/082 118/500
4,872,963 A * 10/1989 Van Horn ..... C25D 13/22 118/500
4,880,194 A * 11/1989 Geise ..... B05B 13/0285 211/200
5,020,677 A * 6/1991 Wirth ..... A47F 5/08 118/500
5,296,030 A 3/1994 Young
5,524,774 A * 6/1996 Cullen ..... B05B 5/082 118/500
5,531,334 A * 7/1996 Forby ..... B05B 13/02 118/500
5,607,069 A * 3/1997 Stroobants ..... B05B 5/082 118/500
D409,858 S 5/1999 Reed
5,906,282 A * 5/1999 Aldrich ..... B65G 49/062 206/454
5,924,577 A * 7/1999 Gessert ..... A47B 81/00 211/162
D418,693 S 1/2000 Kopala, Jr.
D419,335 S 1/2000 Kopala, Jr.
D424,320 S 5/2000 Klein et al.
6,189,709 B1 * 2/2001 Cullen ..... B05B 5/082 211/118
6,530,489 B1 * 3/2003 Van Horn ..... B05B 13/0264 211/113
6,550,623 B2 * 4/2003 Cook ..... B62D 65/18 206/448
6,571,968 B1 * 6/2003 Cullen ..... B05B 5/082 118/500
6,588,605 B1 * 7/2003 Volkert ..... B65D 88/005 206/449
D486,008 S 2/2004 Pospisil et al.
6,702,130 B1 3/2004 Carlilse
7,021,476 B2 * 4/2006 Lloyd ..... C25D 17/06 118/500
D591,085 S 4/2009 Burns
7,878,338 B2 * 2/2011 Maxson ..... E04G 5/004 211/41.15
8,066,267 B2 * 11/2011 Schaerer ..... F26B 25/18 248/130
8,215,502 B1 * 7/2012 Beavers ..... B05B 5/082 211/119
8,956,514 B2 * 2/2015 Hocevar ..... C25D 17/08 204/297.06
D735,412 S 7/2015 Coleman
D737,077 S 8/2015 Cockayne et al.
D745,794 S 12/2015 Knoll et al.
D785,381 S 5/2017 Johnson
D785,383 S 5/2017 Johnson
9,943,891 B2 * 4/2018 Dixon ..... B08B 11/02
D833,781 S 11/2018 Hartman et al.
10,137,726 B2 11/2018 Murrow
2003/0141267 A1 * 7/2003 Lloyd ..... C25D 17/06 211/113
2003/0209504 A1 * 11/2003 Cook ..... B62D 65/18 211/13.1
2004/0206713 A1 * 10/2004 Lloyd ..... C25D 17/06 211/113
2004/0238465 A1 * 12/2004 Mercure ..... A47B 81/00 211/41.14
2006/0196838 A1 * 9/2006 Mercure ..... A47F 7/0042 211/41.1
2012/0273439 A1 * 11/2012 Beavers ..... B05B 5/082 211/26
2017/0120313 A1 * 5/2017 Dixon ..... B08B 11/02

* cited by examiner

SYSTEM FOR FACILITATING THE TRANSPORTATION OF HANGERS

CROSS-REFERENCE TO RELATED APPLICATION

This application is a continuation of U.S. patent application Ser. No. 14/930,996 filed Nov. 3, 2015, the disclosures of which are hereby incorporated by reference in their entirety.

TECHNICAL FIELD

Exemplary embodiments of the present invention relate generally to a system for facilitating the transportation of hangers.

BACKGROUND AND SUMMARY OF THE INVENTION

Powder coating is a widely known method of applying coatings to components during a manufacturing process. In the powder coating process, parts to be coated are suspended on a rack or other hanging system. Frequently the hanging system is a cable or chain conveyor system that moved the parts through the various stages of the coating process. Workers or automated systems place the parts to be coated onto rack or hanging system using hooks. These hooks are generally sized such that the part hangs below the conveyer an amount sufficient to prevent coatings from adhering to the conveyor itself. Once the parts are positioned on the conveyor system those parts are subjected to a static charge such that the parts become charged. A powdered coating material is then introduced to the part. Often this is performed by blowing the coating across the part. The charge produced on the part causes a certain amount of powdered coating material to become attracted to and stick to the part. The powder that doesn't stick to the part may be recycled for later use. The parts, now coated with a uniform layer of coating material are moved into an oven where heat is applied to melt the powdered coating material. This heat causes the material to melt and form a permanent coating on the part to be coated. The powder coating process has many advantages over a spray or dip coating application and as a result, the powder coating process continues to grow in popularity.

In addition to powder coating processes, hangers may also be used in "wet" coating processes—that is, coating methods that use solvents to suspend the coating materials during the application process. Common wet coating methods include spraying and dipping. As with powder coating, these methods may use hangers to suspend work pieces during the application of a coating material.

In many coating processes the coating material is unavoidably applied to the hanger that is used to hang the part to be coated on the conveyer or other system used to transport the coated parts. After repeated coatings, the hanger may be subject to a buildup of coating material that may make it difficult to remove the parts, negatively impact the part coating quality or may cause the hanger to become unusable. Known methods of removing this built-up coating from parts hangers include placing the hangers in an oven and heating them to a point at which the bond between the coating and the hanger fails and the coating can be easily removed (generally referred to as a "burn-off" process). Currently, this burn-off process is generally performed in a dedicated cleaning oven. Such an oven may not be economically feasible for an organization which performs a limited amount of coating. As a result, hangers must be gathered from the coating process and moved to the cleaning oven location. In addition, the hangers must be arranged such that they are evenly heated. Ideally such an arrangement allows for a uniform distribution of the hangers in the cleaning oven.

What is needed is a system and method for storage, transportation and cleaning of coated hangers. In an embodiment of the invention, a rack structure may be formed that permits coated hangers to be hung from the rack after use and transported to the location of the cleaning oven for coating. In such an embodiment, each rack structure may comprise a series of primarily horizontal rails upon which the coated hangers may be suspended. In embodiments of the invention, a second horizontal rail may be positioned such that it is parallel with the first rail and is arranged such that it may be positioned to form a space between the first and second rails sufficient to permit hangers to be hung from the first rail. In such an embodiment, the second horizontal rail may be repositioned such that it moves closer to the first rail and as a result, captures the hangers between the two rails. This capture may permit the rack structure to be moved to location of the cleaning oven with the hangers in place without the hangers falling off of the structure. Embodiments of the invention may comprise a plurality of such rails. Certain embodiments of the invention may also be configured to allow multiple racks to be positioned together for shipment from a first location to a cleaning location in order to provide a more stable and compact structure.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
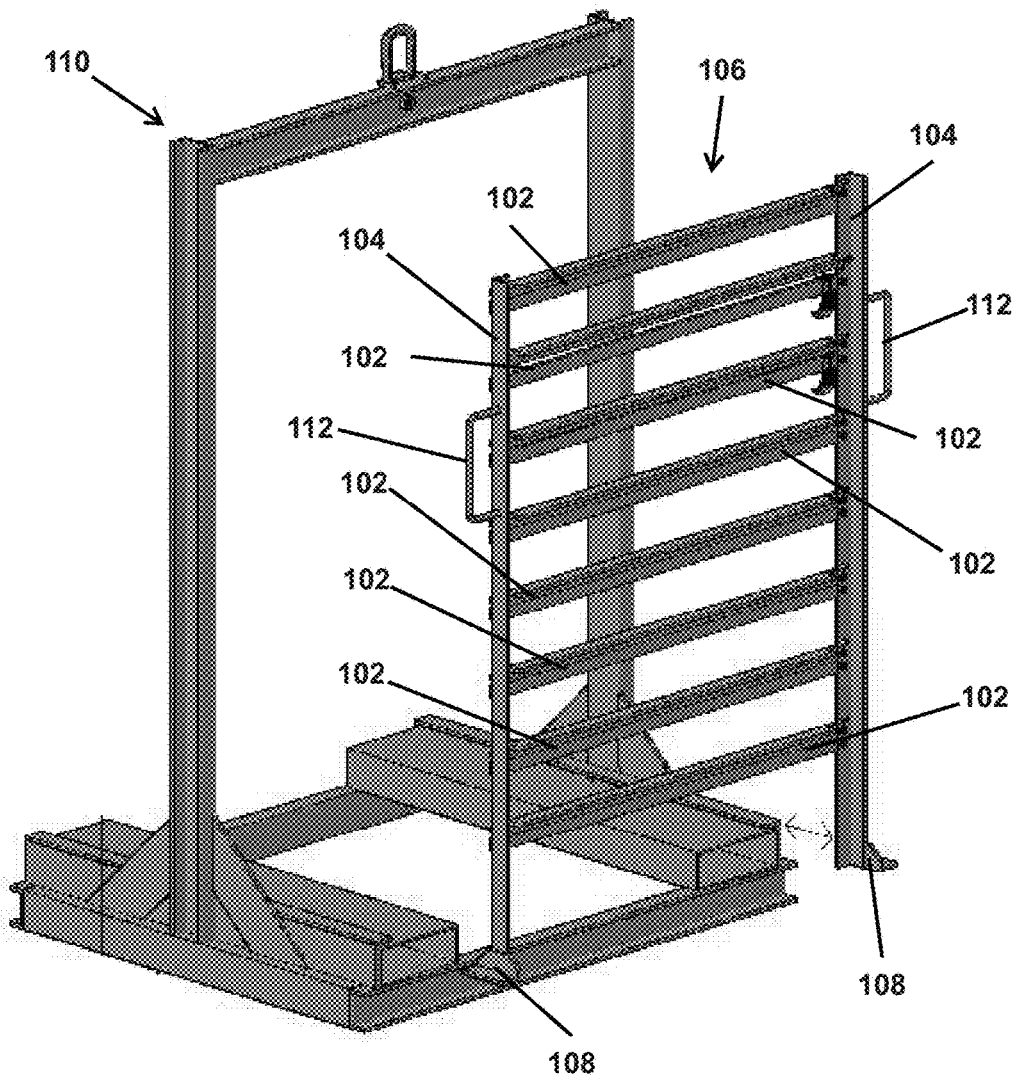
FIG. 1 is a perspective view of an embodiment of the invention illustrating a rack and a rack transporting device.

Referring to FIG. 1, an example embodiment is shown with a plurality of horizontal hanging rails 102. As is illustrated, these rails may be located between a pair of vertical rails 104 to form a cleaning rack structure 106. In addition to the horizontal 102 and vertical rails 104, embodiments of the invention may also comprise a base structure 108. In certain embodiments of the invention, the base structure 108 illustrated in FIG. 1 is intended for insertion into a rack transportation frame 110. Other embodiments of the cleaning rack 106 may also be configured with a base structure that will support the cleaning rack in an upright position without the need for a transportation frame. Embodiments of the invention may also comprise handling devices such as handles 112 to facilitate easy handling of the racks as they are inserted and removed from the transportation frame.

Figure 2:
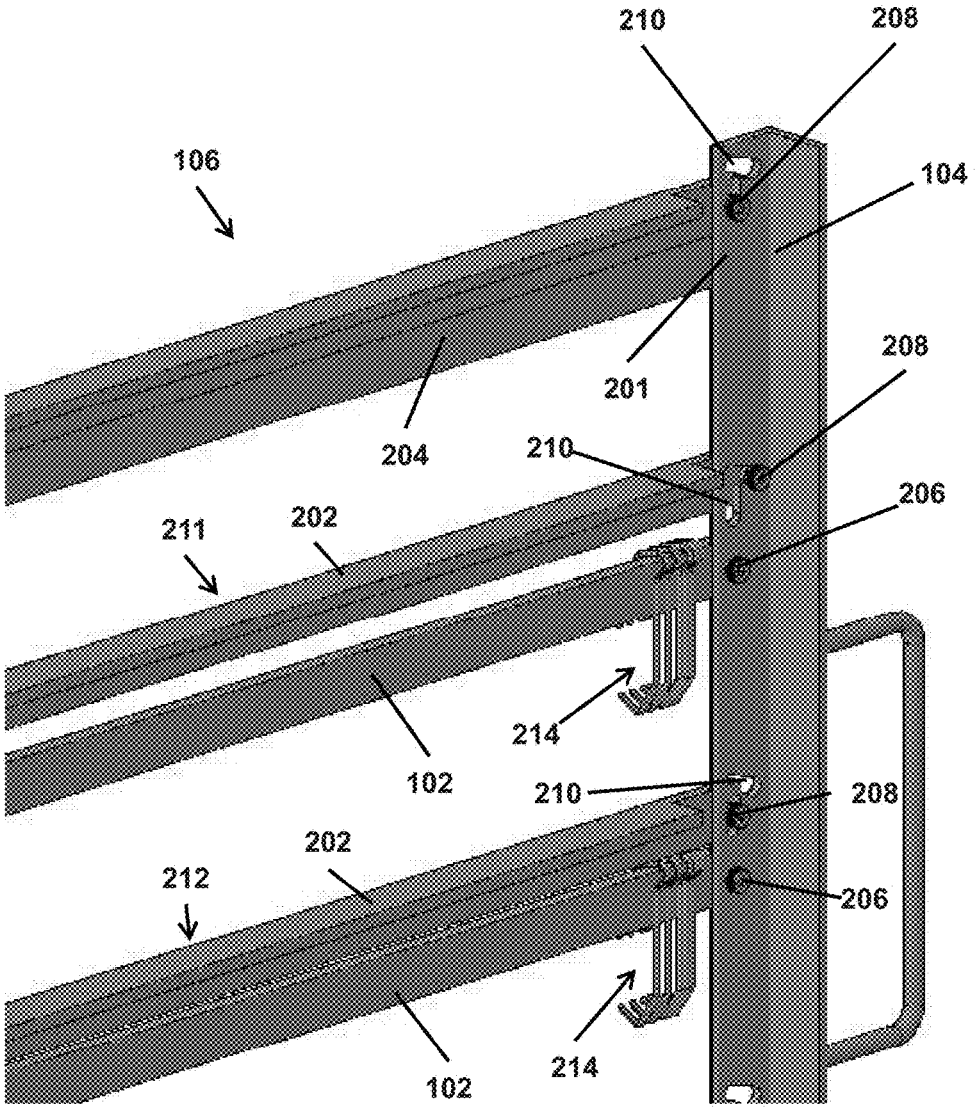
FIG. 2 is a view of a first and second horizontal rail in an embodiment of the invention.

As is illustrated in FIG. 2, the horizontal hanging rails 102 may be secured without fasteners through the use of welding or a similar process as illustrated at 201. This may be particularly beneficial for the upper most and lowest rails of a cleaning rack 106 to permit the formation of a more rigid cleaning rack structure. As is shown, a horizontal hanging rail 102 may also be secured to a vertical rail 104 by the use of a fastener 206. Such a fastener may include, but is not limited to, screws, nuts and bolts, or rivets. The use of a removable fastener such as a nut and bolt may permit the horizontal rails to be repositioned or removed as needed to accommodate larger hangers. For example, should a situation arise wherein the hangers are sufficiently long as to impact the hanging rail below the rail upon which the hangers are hung, interfering hanging rail and upper rail may be removed to permit the longer hangers to be suspended from a hanging rail 102 unimpeded.

As shown in FIG. 2, an upper rail 202 may be positioned above the handing rail 102. This upper rail may be positioned such that it may be moved to a second position in order to secure hangers suspended from the hanging rail. This is illustrated at 212. As is shown in FIG. 2, a slot 210 may be formed in a horizontal rail such that the upper rail 202 may be moved from a first position shown at 211 to a second position illustrated at 212. In certain embodiments of the invention, such a slot 210 may comprise a vertical portion and a horizontal portion such that the upper rail may be lifted up held in such a position by a fastener 208 that is moved into a horizontal portion of the slot 210, resulting in the upper rail being suspended above the hanging rail 102. In other embodiments, the slot 210 may comprise only a vertical portion and use a fastener 208 that may be tightened in order to hold the upper rail 202 away from the hanging rail 102 while hangers are positioned on the hanging rail for cleaning. As is illustrated at 212, when upper rail 202 is lowered, it may trap a plurality of hangers 214 against the hanging rail 102, thereby preventing the hangers from falling from the hanging rail during transportation. In certain embodiments of the invention, the fastener 208 may be tightened to further secure the hangers 214 between the rails.

Figure 3:
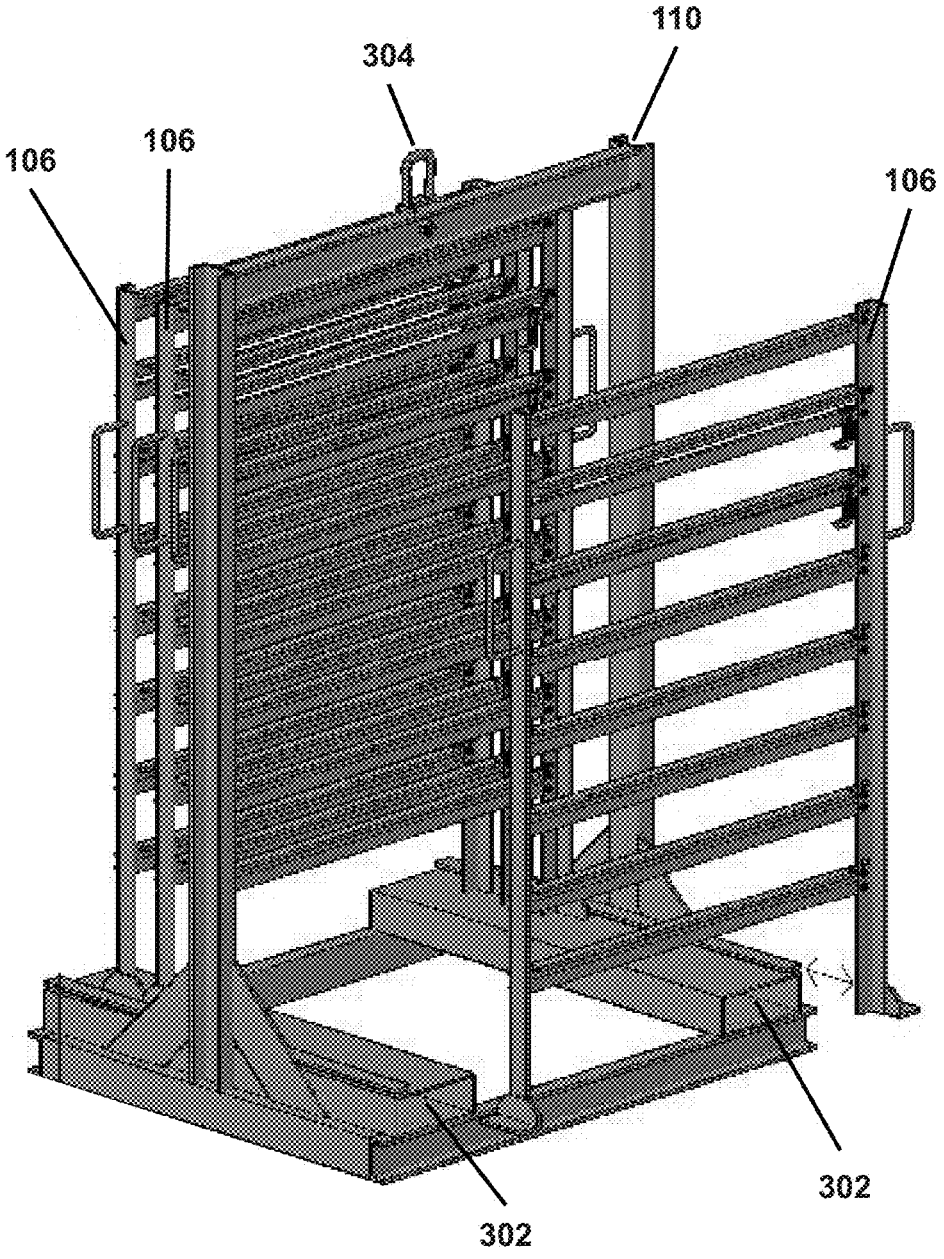
FIG. 3 is a perspective view of an embodiment of the invention illustrating the positioning of multiple racks positioned in a rack transporting device.

Referring again to FIG. 1, in order to facilitate efficient transportation of cleaning racks 106 to a burn-off location, a plurality of cleaning racks may be positioned in a rack transportation frame 110. As is shown at 108, in certain embodiments of the invention, cleaning racks 106 may be equipped with a foot structure 108 that may be inserted into a rail or other interface for receiving such a foot on the rack transportation frame 110. As is shown in FIG. 3, a plurality of cleaning racks 106 may be inserted into a rack transportation frame 110 prior to transportation of the cleaning racks to a burn-off facility. As is shown in the embodiment illustrated in FIG. 3, the transportation frame 110 may comprise features that allow the frame to be easily transported or maneuvered. Examples include lifting eyes 304 and forklift channels 302. Other embodiments may also comprise wheels or skids to enable the easy movement of the transportation frame when loaded with cleaning racks 106.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A rack for securing and transporting a plurality of hangers, each comprising an upper portion and configured for suspending parts for powder coating, the rack comprising:

a first and second substantially vertical rail, each comprising a plurality of individual slots;

a first plurality of substantially horizontal rails extending between, and fixed to, said first and second substantially vertical rails in a non-slidable fashion, wherein each of said first plurality of substantially horizontal rails are configured to accept one or more of the plurality of hangers in a suspended arrangement such that the upper portion of each respective hanger is configured to extend across an upper surface of the respective one of the first plurality of substantially horizontal rails; and a second plurality of substantially horizontal rails extending between said first and second substantially vertical rails, each of said second plurality of substantially horizontal rails being received within one of the plurality of individual slots on each of the first and second substantially horizontal rails;

wherein said plurality of individual slots are configured to permit each of the second plurality of substantially horizontal rails to be selectively moved into contact with a respective one of the first plurality of substantially horizontal rails so as to trap the upper portion of each of said suspended hangers between the first and second substantially horizontal rails.

2. The rack of claim 1 wherein:

each of the second plurality of substantially horizontal rails are located above a respective one of the first plurality of substantially horizontal rails.

3. The rack of claim 2 wherein:

said first and second substantially vertical rails extend substantially parallel with one another.

4. The rack of claim 3 wherein:

each of said first and second plurality of substantially horizontal rails extend substantially parallel with one another.

5. The rack of claim 1 wherein:

each of said individual slots comprise:

a substantially vertical portion; and a substantially horizontal portion connected to said substantially vertical portion.

6. The rack of claim 5 further comprising:

a first and second fastener located on each end of each of the second plurality of substantially horizontal rails, wherein each of said fasteners are configured to be placed within one of said plurality of individual slots.

7. The rack of claim 6 wherein:

each of the plurality of individual slots are located such that each of said second plurality of substantially horizontal rails may be selectively secured apart from, and selectively moved into contact with, a respective one of the first plurality of substantially horizontal rails located below a respective one of said second plurality of substantially horizontal rails.

8. The rack of claim 1 further comprising:

a base structure located at the lower end of each of said first and second substantially vertical rails.

9. The rack of claim 1 further comprising:

a first handle located on the first substantially vertical rail; and a second handle located on the second substantially vertical rail.

10. A rack for securing and transporting a plurality of hangers, each comprising a hook and configured for suspending parts for powder coating, the rack comprising:

a first and second vertical rail, each comprising a series of apertures vertically spaced apart along both the first and second vertical rails;

a base structure located at the lower end of each of said first and second vertical rails;

a first plurality of horizontal rails extending between, and fixed to, said first and second vertical rails, wherein each of said first plurality of horizontal rails are configured to accept the plurality of hangers in a suspended arrangement such that the hook of each of said hangers is configured to extend across an upper surface of each of the first plurality of horizontal rail; and a second plurality of horizontal rails extending between said first and second vertical rails and moveably attached thereto in a way which permits the second plurality of horizontal rails to be selectively moved into contact with the first plurality of horizontal rails to trap the hook of each of said suspended hangers between the first and second plurality of horizontal rails;

wherein each of said first plurality of horizontal rails are configured to be secured to said first and second vertical rails by way of fasteners passing through said series of apertures such that each of said first plurality of horizontal rails may be removed from said first and second vertical rails but are prevented from being vertical repositioned when secured to said first and second vertical rails.

11. The system of claim 10 wherein:

the movement of said second plurality of horizontal rails is guided by channels formed in said vertical rails;

said channels comprise a vertical slot and a horizontal slot, wherein the slots are configured to permit the second plurality of horizontal rails to be selectively moved vertically and horizontally relative to the first plurality of horizontal rails.

12. The system of claim 11 wherein:

said channels are each configured to accommodate a fastener located on said second plurality of horizontal rails.

13. The system of claim 12 further comprising:

a second rack for the transportation of a plurality of said racks, the second rack comprising:

a first and second vertical member, a horizontal member attached at its ends to the upper ends of said vertical members, and a second base structure comprising a first and second member oriented substantially parallel to one another and substantially perpendicular to said vertical members, wherein the lower ends of said vertical members are attached to said second base structure;

wherein said second rack is configured to accept a plurality of said racks.

14. The system of claim 13 further comprising:

a lifting eye located on the horizontal member.

15. The system of claim 13 further comprising:

a plurality of openings in the second base structure configured to accept the forks of a lift truck.

16. The system of claim 10 further comprising:

at least one handle located on the first or second vertical rail.

17. The system of claim 10 wherein:

said first and second substantially vertical rails extend substantially parallel with one another; and each of said first plurality of horizontal rails extends substantially in parallel with each of said second plurality of horizontal rails.

18. A rack for securing and transporting a plurality of hangers, each comprising a hook and configured for suspending parts for powder coating, the rack comprising:

a first and second substantially vertical rail, each comprising a series of apertures vertically spaced apart along both the first and second substantially vertical rails;

a base structure located at a lower end of each of said first and second substantially vertical rails;

a plurality of fasteners, each of which extend through one of said series of apertures;

a first plurality of horizontal rails extending between said first and second vertical rails, wherein each of said first plurality of horizontal rails are fixed to the first and second vertical rails in a non-slidable fashion at either end thereof by way of the plurality of fasteners and series of apertures, and wherein each of said first plurality of horizontal rails is configured to accept the plurality of independent hangers in a suspended arrangement such that the hook of each of said hangers extends across an upper surface of each of the first plurality of horizontal rail;

a second plurality of horizontal rails extending between said first and second vertical rails and moveably attached thereto in a way which permits the second plurality of horizontal rails to be selectively moved into contact with the first plurality of horizontal rails to trap the hook of each of said suspended hangers between the first and second plurality of horizontal rails; and a second rack comprising:

a first and second vertical member, a horizontal member attached at its ends to an upper end of said vertical members, and a second base structure comprising a first and second member oriented substantially parallel to each other and substantially perpendicular to said vertical members and attached to a lower end of said vertical members, wherein said second rack is configured to accept a plurality of said racks;

wherein each of said first plurality of horizontal rails are prevented from being vertically repositioned when secured to said first and second vertical rails by way of said plurality of fasteners and series of apertures.

* * * * *